US008344635B2

(12) United States Patent
Gao

(10) Patent No.: US 8,344,635 B2
(45) Date of Patent: Jan. 1, 2013

(54) DRIVING REGULATION METHOD FOR BIPOLAR TRANSISTORS IN ELECTRONIC BALLAST AND THE DEVICE THEREOF

(75) Inventor: Wei Gao, Guangzhou (CN)

(73) Assignee: Osram Gesellschaft Mit Beschraenkter Haftung, Munich (DE)

( * ) Notice: Subject to any disclaimer, the term of this patent is extended or adjusted under 35 U.S.C. 154(b) by 451 days.

(21) Appl. No.: 12/531,909

(22) PCT Filed: Mar. 6, 2008

(86) PCT No.: PCT/EP2008/052734

§ 371 (c)(1),
(2), (4) Date: Sep. 18, 2009

(87) PCT Pub. No.: WO2008/113696

PCT Pub. Date: Sep. 25, 2008

(65) Prior Publication Data

US 2010/0026197 A1 Feb. 4, 2010

(30) Foreign Application Priority Data

Mar. 22, 2007 (CN) ..... 2007 1 0089790

(51) Int. Cl.
*H05B 41/36* (2006.01)
*H05B 37/02* (2006.01)

(52) U.S. Cl. ..... 315/224; 315/244

(58) Field of Classification Search ..... 315/224, 315/244, 291, 307, DIG. 5, DIG. 7, 326, 315/200 R See application file for complete search history.

(56) References Cited

U.S. PATENT DOCUMENTS

| | | | | |
|---|---|---|---|---|
| 5,642,065 | A | 6/1997 | Choi et al. | |
| 6,002,214 | A | 12/1999 | Ribarich | |
| 7,449,844 | B2 * | 11/2008 | Lev et al. | 315/291 |
| 2005/0035729 | A1 * | 2/2005 | Lev et al. | 315/291 |

FOREIGN PATENT DOCUMENTS

| | | | |
|---|---|---|---|
| EP | 0641149 | B1 | 11/1999 |
| WO | 0178468 | A1 | 10/2001 |

OTHER PUBLICATIONS

International Search Report of PCT/EP2008/052734 mailed on Jun. 3, 2008.

* cited by examiner

*Primary Examiner* — Daniel D Chang

(57) ABSTRACT

A method of driving regulation for bipolar transistors in electronic ballast is provided. The method may include: sensing voltage at midpoint of half bridge of the transistors; producing a reference time signal according to a sync signal from a timer; producing actual time interval in this cycle by comparing rising edge of the voltage at midpoint of the half bridge of the transistors with rising edge of a driving signal for the transistors in upper bridge arm in each switching cycle; comparing the actual time interval with the reference time signal to determine pulse width of the driving signal; regulating, in which the driving signal in this switching cycle is prolonged relative to the driving signal in previous switching cycle if the actual time interval is larger than the reference time signal, while the driving signal in this switching cycle is shortened relative to the driving signal in previous switching cycle if the actual time interval is smaller than the reference time signal.

7 Claims, 2 Drawing Sheets

DRIVING REGULATION METHOD FOR BIPOLAR TRANSISTORS IN ELECTRONIC BALLAST AND THE DEVICE THEREOF

RELATED APPLICATIONS

The present application is a national stage entry according to 35 U.S.C.§371 of PCT application No.: PCT/EP2008/052734 filed on Mar. 6, 2008, which claims priority from Chinese application No.: 200710089790.5 filed on Mar. 22, 2007.

FIELD OF THE INVENTION

The present invention relates to a method and device which can be used to drive bipolar transistors in half bridge topology for electronic ballast and electronic transformer.

BACKGROUND OF THE INVENTION

A fluorescent lamp and a high-intensity gas discharge lamp have advantages of high ruminating efficiency, long life, wide power range, etc., such that they have occupied an important position in illumination field at present. In course of illuminating the fluorescent lamp and the high-intensity gas discharge lamp, electronic beam produces light when passing through a gas medium. However, the illumination of such lamps needs to use the ballast. Because the electronic ballast has advantages of high efficiency, small volume and flexible control, it has replaced the traditional inductive ballast more and more.

How to drive bipolar transistors in half bridge topology for electronic ballast and electronic transformer and keep them in soft switching state at any operating frequency is very significant for reducing source current and power consumption. In prior art, the method for addressing this problem is to sense rising edge of voltage in the middle of half bridge and compare it with an internal signal to decide whether driving for switching bipolar transistors is too strong or too weak, thus keeping these transistors in soft switching state. Then, the current level for driving transistors is regulated so as to obtain proper driving for transistors. However, such control logic is useful only in course of normal operation, and it's not available during preheating and ignition.

SUMMARY OF THE INVENTION

The object of the present invention is to provide a method and device of driving regulation, which can utilize ASIC to drive switching bipolar transistors used in half bridge for electronic ballast and electronic transformer, to keep them in soft switching state at any operating frequency. For this purpose, the present invention adopts the technical solution as follows.

According to the first aspect of the present invention, a method of driving regulation for bipolar transistors in the electronic ballast is provided, including the steps of: sense for sensing voltage at midpoint of the half bridge of transistors; reference time signal generation for producing the reference time signal according to a sync signal from a timer; time interval generation for producing actual time interval in this cycle by comparing rising edge of voltage at midpoint of the half bridge of transistors with rising edge of a driving signal for transistors in upper bridge arm in each switching cycle; comparison for comparing the actual time interval with the reference time signal to determine pulse width of the driving signal; regulation, in which the driving signal in this switching cycle is prolonged relative to the driving signal in previous switching cycle if the actual time interval is larger than the reference time signal, while the driving signal in this switching cycle is shortened relative to the driving signal in previous switching cycle if the actual time interval is smaller than the reference time signal.

Optionally, in the step of time interval generation, the actual time interval of this cycle is produced by comparing falling edge of voltage at midpoint of the half bridge of transistors with rising edge of the driving signal for transistors in upper bridge arm in each switching cycle.

Preferably, the reference time interval is 2 μs.

According to the second aspect of the present invention, a device of driving regulation for bipolar transistors in the electronic ballast is provided, including a sense unit for sensing voltage at midpoint of the half bridge of transistors and transforming amplitude of the voltage into a voltage signal which can be accepted by a control circuit; a timer unit for producing a frequency signal which can control the switching frequency of the transistor, and producing a control signal at the same time which is in synchronism with the frequency signal and has multiple frequency; a reference timer unit for producing a reference time interval signal according to the signal provided by the timer to supply a logical decision and control unit as the reference value for driving decision; a pulse width modulation unit for producing a driving signal with alternately adjustable pulse width according to the frequency produced by the timer unit and the control signal provided by the logical decision and control unit, and supplying it to a transistor driving unit; a transistor driving unit, in which voltage and current transformation is performed on the driving signal produced by the pulse width control unit to drive transistors in the half bridge circuit; a logical decision and control unit for producing a control signal according to the signals from the sense unit, the reference timer unit and the timer unit and internal logic, and supplying it to the pulse width modulation unit to regulate the driving signal for transistors, so that the driving signal can meet requirements of transistor in different conditions and states.

Preferably, the sense unit is a resistance voltage divider; the timer unit consists of a controlled RC oscillator and a gate circuit; the reference timer unit is a monostable trigger and the reference time interval is 2 μs; the transistor driving unit is a drive pulse transformer and it doesn't change time sequence of the driving signal; the logical decision and control unit can also control the timer unit to produce signals with different switching frequencies in order to satisfy requirements of the electronic ballast in states of preheating, ignition, normal operation and even light modulation of the fluorescent lamp; the logical decision and control unit can also identify various abnormal states of the electronic ballast based on various input signals, thus closing the pulse width modulation unit so as to realize protective function.

The control method and device according to the technical solution of the present invention are flexible enough to drive switching bipolar transistors throughout the working period of the electronic ballast. The control method contributes to reducing power consumption and source current for controlling ASIC.

BRIEF DESCRIPTION OF THE DRAWINGS

The present invention will be described in more detail below, in combination with the accompanying figures, in which.

DETAILED DESCRIPTION OF THE INVENTION

Figure 1:
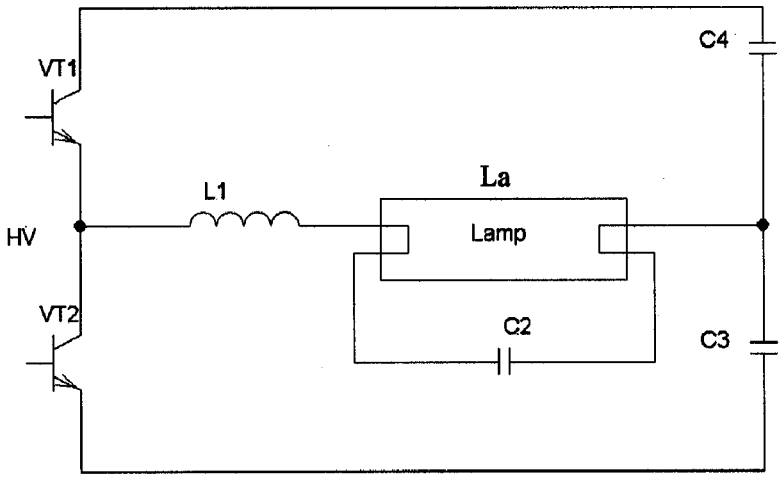
FIG. 1 shows a power loop for electronic ballast.

As shown in FIG. 1, a power loop for an electronic ballast is provided, in which a half bridge resonance circuit for a classical electronic ballast is composed of transistors VT1, VT2, a resonant inductor L1, a resonant capacitor for ignition C2, half bridge capacitors C3, C4 and a load La (i.e. a fluorescent lamp).

Figure 2:
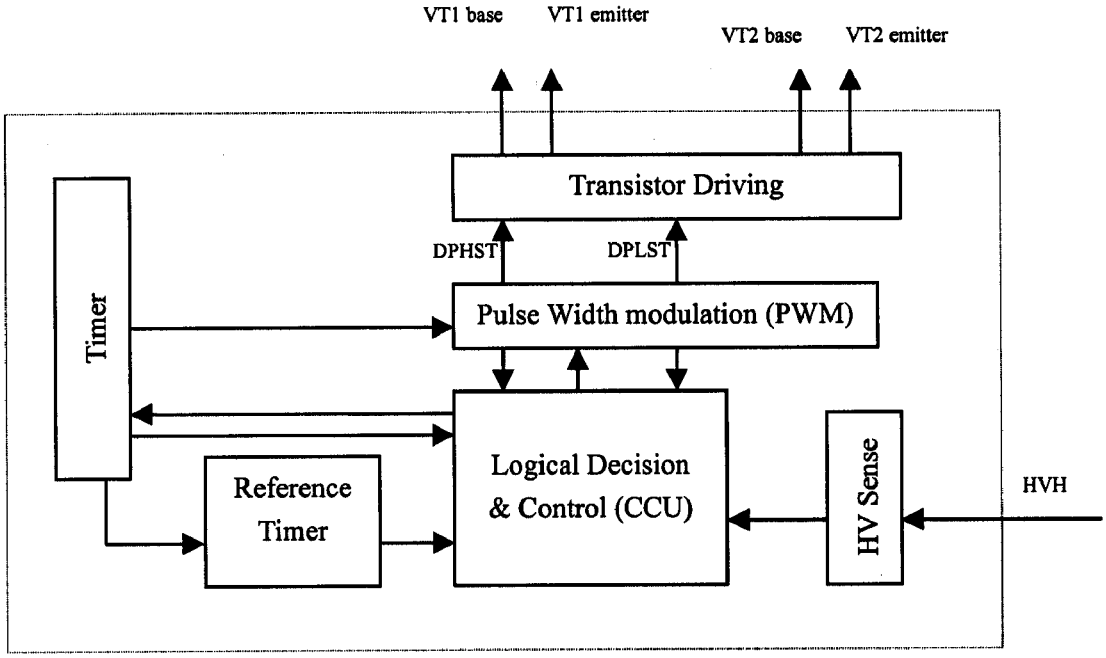
FIG. 2 is a block diagram of a device of driving regulation for bipolar transistors in electronic ballast according to the present invention.

FIG. 2 is a block diagram of a device of driving regulation for bipolar transistors in an electronic ballast according to the present invention, in which the arrow represents flow direction of the signal. The whole control circuit includes the following parts: a HV sense (HVS) unit, a logical decision and control (CCU) unit, a timer unit, a reference timer (RT) unit, a pulse width modulation (PWM) unit, and a transistor driving (TD) unit. Their functions are explained as follows, respectively:

HV Sense Unit (HVS)

HV sense unit is used to sense voltage HV at midpoint of the half bridge arm (as the HV shown in FIG. 3) and transform amplitude of the voltage (typical value is a square wave of 200~400 Vp-p) into a voltage signal HVL (typical value is 5 Vp-p) which can be accepted by a control circuit. The HV sense circuit can make HVL actually reflect change in HV. The HV sense unit may be a simple resistance voltage divider.

Timer Unit

The timer unit is used to produce a frequency signal which can control switching frequency (SF) of power transistors TV1, TV2 and produce a control signal at the same time, which is in synchronism with SF and has multiple frequency, to supply PWM, CCU, RT units etc. for use. The frequency produced by this unit can also be controlled by CCU so that various frequencies are produced to meet requirements of the electronic ballast in states of preheating, ignition, normal operation and even light modulation of the fluorescent lamp. The timer unit may be composed of the controlled RC oscillator and some gate circuits.

Reference Timer (RT) Unit

Figure 3:
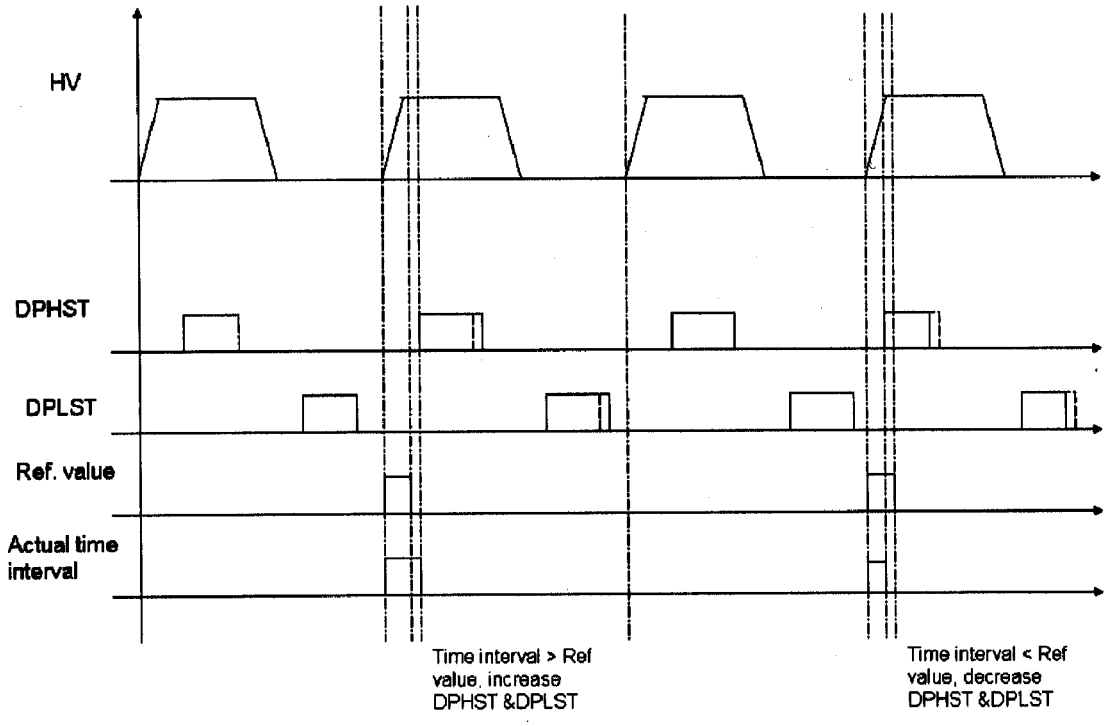
FIG. 3 is a sequence chart of process of driving regulation for bipolar transistors in electronic ballast according to the present invention.

The reference timer is used to produce a reference time interval signal according to the signal provided by the timer to supply CCU unit as the reference value for driving decision, such as Ref.value shown in FIG. 3. The reference timer may be a monostable trigger. Ref.value can be changed according to different operating circuits, and its typical value may be 2 μs.

Pulse Width Modulation (PWM) Unit

The pulse width modulation unit is used to produce a driving signal with alternately adjustable pulse width according to the frequency produced by the timer unit and the control signal provided by CCU unit and supply it to the transistor driving unit. The driving signal is DPHST and DPLST shown in FIG. 3. The circuit for performing pulse width modulation is well known and reference can be made to UC3525 produced by ST Co.

Transistor Driving (TD) Unit

The transistor driving unit can perform voltage and current transformation on the driving signal produced by PWM unit (such as DPHST and DPLST shown in FIG. 3) to drive transistors (VT1, VT2) in the half bridge circuit, but doesn't change time sequence of the driving signal. The transistor driving unit may be a drive pulse transformer.

Logical Decision and Control (CCU) Unit

The logical decision and control unit is used to produce a control signal according to the signals from HVS unit, RT unit and Timer unit, and internal logic, and supply it to PWM unit to regulate the driving signal for transistors (VT1, VT2), so that the driving signal can meet requirements of transistor in different conditions and states.

Additionally, CCU unit can also control Timer unit to produce control signals with different switching frequencies in order to meet requirements of the electronic ballast in states of preheating, ignition, normal operation and even light modulation of the fluorescent lamp.

Additionally, CCU unit can also decide various abnormal states of the electronic ballast based on various input signals, thus closing PWM unit so as to realize protective function.

The process of driving regulation for bipolar transistors in electronic ballast according to the present invention is as follows:

Referring to FIG. 3, a sequence chart of process of driving regulation for bipolar transistors in the electronic ballast according to the present invention is shown, in which HV is the voltage at midpoint of the half bridge of transistors (that is, connection point between VT1 and VT2), as shown in FIG. 1; DPHST is the driving signal for transistor VT1 in upper bridge arm of the half bridge of transistors; DPLST is the driving signal for transistor VT2 in upper bridge arm of the half bridge of transistors; Ref.value is a particular reference time signal which is provided by the reference timer according to the sync signal from the Timer and supplied to CCU unit for logical decision; and the actual time interval (ATI) refers to the actual time interval between rising edge of HV and rising edge of DPHST in each switching cycle.

In each switching cycle, i.e. VT1 and VT2 each are turned on once, CCU unit will compare rising edge of HV with rising edge of DPHST to produce the actual time interval ATI in this cycle. This ATI will be compared with the reference time signal (i.e. Ref.value signal) produced by RT unit to determine pulse widths of the driving signals DPHST and DPLST. If the actual time interval ATI is larger than the reference time signal Ref.value, the driving signals DPHST and DPLST in this switching cycle are prolonged relative to the driving signals DPHST and DPLST in previous switching cycle. The specific process of prolonging the driving signals DPHST and DPLST is that CCU unit provides a control level signal for PWM unit while PWM unit outputs corresponding pulse width according to the level signal. The higher the control voltage which CCU unit provides for PWM unit is, the wider the pulse width output by PWM unit is. If the actual time interval ATI sensed by CCU unit is larger than the reference time signal Ref.value, CCU unit will enhance the control voltage output to PWM unit so that PWM unit will prolong pulse widths of the driving signals DPHST and DPLST in this switching cycle according to the control voltage output by CCU unit. In this case, pulse widths in this switching cycle are prolonged relative to pulse widths of DPHST and DPLST in previous switching cycle, and vice versa. In each switching cycle, the widths of DPHST and DPLST are equal. The control logic can guarantee that the switching transistors VT1 and VT2 are able to be properly driven so as to ensure VT1 and VT2 to operate in soft switching mode and avoid high switching loss.

Under this control logic, switching frequency of the half bridge circuit can be changed based on practical requirements, such as different requirements of preheating, ignition, normal operation and light modulation etc. However, the transistors in the half bridge are still kept in soft switching state.

The time interval between falling edge of HV and rising edge of DPLST is equivalent with the actual time interval ATI between rising edge of HV and rising edge of DPHST as above described. For convenience, only the latter situation is described.

What is claimed is:

1. A method of driving regulation for bipolar transistors in an electronic ballast, the method comprising:

sensing voltage at midpoint of half bridge of the transistors;

producing a reference time interval according to a sync signal from a timer;

producing an actual time interval in each of a plurality of switching cycles by comparing rising edge of the voltage at midpoint of the half bridge of the transistors with rising edge of a driving signal for the transistors in upper bridge arm;

comparing the actual time interval with the reference time interval to determine a pulse width of the driving signal;

regulating, in which the pulse width of the driving signal in one of said plurality of switching cycles is prolonged relative to the pulse width of the driving signal in a previous one of said plurality of said switching cycles if the actual time interval is larger than the reference time interval, while the pulse width of the driving signal in said one of said plurality of switching cycles is shortened relative to the pulse width of the driving signal in a previous one of said plurality of switching cycles if the actual time interval is smaller than the reference time interval.

2. The method of driving regulation for bipolar transistors in an electronic ballast according to claim 1, wherein the actual time interval is produced by comparing falling edge of the voltage at midpoint of the half bridge of the transistors with rising edge of the driving signal for the transistors in upper bridge arm.

3. The method of driving regulation for bipolar transistors in an electronic ballast according to claim 2, wherein the reference time interval is 2 μs.

4. The method of driving regulation for bipolar transistors in an electronic ballast according to claim 1, wherein the reference time interval is 2 μs.

5. A device for driving regulation for bipolar transistors in an electronic ballast, the device comprising:

a sensor configured to sense voltage at midpoint of a half bridge of the transistors and to transform an amplitude of the voltage into a voltage signal for a control circuit;

a timer configured to produce a frequency signal for controlling the switching frequency of the transistor, and to produce a control signal at the same time which is in synchronism with the frequency signal and has multiple frequency;

a reference timer configured to produce a reference time interval signal according to the frequency signal to provide a reference value;

a logical decider and controller having an internal logic, the logical decider and controller configured to produce a control signal according to signals from the sensor, the reference timer and the timer and the internal logic;

a pulse width modulator configured to produce a driving signal with alternately adjustable pulse width according to the frequency signal produced by the timer and the control signal provided by the logical decider and controller;

a transistor driver configured to perform voltage and current transformation on the driving signal to drive the transistors in the half bridge circuit;

wherein the pulse width modulator regulates the driving signal for the transistors depending on the condition and state thereof.

6. The device for driving regulation for bipolar transistors in an electronic ballast according to claim 5, wherein the logical decider and controller is also configured to control the timer to produce signals with different switching frequencies corresponding to different states of the electronic ballast.

7. The device for driving regulation for bipolar transistors in an electronic ballast according to claim 5, wherein the logical decider and controller is also configured to identify an abnormal state of the electronic ballast based on a corresponding input signal, thus shutting down the pulse width modulator, performing in such way a protective function.

* * * * *